US010217422B2

(12) United States Patent
Li et al.

(10) Patent No.: US 10,217,422 B2
(45) Date of Patent: Feb. 26, 2019

(54) ARRAY SUBSTRATE, DRIVING METHOD THEREOF AND ELECTRONIC PAPER

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Yue Li, Beijing (CN); Xiaochuan Chen, Beijing (CN); Lei Wang, Beijing (CN); Wenjun Xiao, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 365 days.

(21) Appl. No.: 15/070,422

(22) Filed: Mar. 15, 2016

(65) Prior Publication Data

US 2016/0300536 A1 Oct. 13, 2016

(30) Foreign Application Priority Data

Apr. 9, 2015 (CN) ..... 2015 1 0166590

(51) Int. Cl.
*G09G 3/34* (2006.01)

(52) U.S. Cl.
CPC ..... *G09G 3/344* (2013.01); *G09G 2300/0408* (2013.01); *G09G 2300/0426* (2013.01);
(Continued)

(58) Field of Classification Search
CPC combination set(s) only.
See application file for complete search history.

(56) References Cited

U.S. PATENT DOCUMENTS

2005/0212446 A1* 9/2005 Eom ..... G09G 3/3233 315/169.3
2007/0013707 A1* 1/2007 Kodaira ..... G09G 3/3685 345/549

(Continued)

FOREIGN PATENT DOCUMENTS

CN 1402218 A 3/2003
CN 101025498 A 8/2007

(Continued)

OTHER PUBLICATIONS

Chinese office action dated Oct. 27, 2016.
Chinese office action dated Mar. 23, 2017.

*Primary Examiner* — Robin Mishler
(74) *Attorney, Agent, or Firm* — Dilworth & Barrese, LLP.; Michael J. Musella, Esq.

(57) ABSTRACT

An array substrate, a driving method thereof and an electronic paper. The array substrate includes a base substrate; a plurality of gate lines and a plurality of data lines disposed on the base substrate, the plurality of gate lines and the plurality of data lines being insulated from each other and extending across each other; a gate driving circuit disposed on the base substrate and electrically connected with the gate lines; and a data driving circuit disposed on the base substrate and electrically connected with the data lines. During a display period of a frame, the gate driving circuit is configured to load gate scanning signals to respective gate lines sequentially; and while each gate line is loaded with a respective gate scanning signal, the data driving circuit is configured to transmit data signals to the data lines.

18 Claims, 6 Drawing Sheets

(52) U.S. Cl.
CPC ..... *G09G 2310/0275* (2013.01); *G09G 2310/0281* (2013.01); *G09G 2310/0283* (2013.01); *G09G 2310/0286* (2013.01); *G09G 2380/14* (2013.01)

(56) References Cited

U.S. PATENT DOCUMENTS

| | | | | |
|---|---|---|---|---|
| 2010/0207667 | A1* | 8/2010 | Kwon | G09G 3/3674 327/108 |
| 2011/0122173 | A1* | 5/2011 | Sehata | G09G 3/2007 345/690 |
| 2012/0154344 | A1 | 6/2012 | Peng | |

FOREIGN PATENT DOCUMENTS

| | | | |
|---|---|---|---|
| CN | 101482664 | A | 7/2009 |
| CN | 101546607 | A | 9/2009 |
| CN | 101592832 | A | 12/2009 |
| CN | 103091920 | A | 5/2013 |

* cited by examiner

ARRAY SUBSTRATE, DRIVING METHOD THEREOF AND ELECTRONIC PAPER

TECHNICAL FIELD

Embodiments of the disclosure relates to an array substrate, a method for driving the array substrate and an electronic paper.

BACKGROUND

Electronic papers have visual features similar to papers. Since electronic papers have advantages such as an ultra-wide viewing angle, ultra-low power consumption, a pure reflection mode, a bi-stable display and strong light resistance, electronic papers are often applied in portable devices.

An existing electronic paper typically includes a display panel and an integrated circuit. The electronic paper implements image display by applying driving signals to gate lines and data lines in the display panel with the integrated circuit.

At present, low cost and a narrow rim are the development trend for an electronic paper. However, the integrated circuit may restrict the electronic paper to advance towards low cost and a narrow rim. Therefore, how to achieve a narrow rim in the electronic paper and reduced manufacturing cost becomes an urgent technical problem to be addressed by those skilled in the art.

SUMMARY

Embodiments of the disclosure provide an array substrate, a method for driving the array substrate and an electronic paper, which allows the electronic paper to achieve a narrow rim and a reduced manufacturing cost.

Embodiments of the disclosure provide an array substrate, including: a base substrate; a plurality of gate lines and a plurality of data lines disposed on the base substrate, the plurality of gate lines and the plurality of data lines being insulated from each other and extending across each other; a gate driving circuit disposed on the base substrate and electrically connected with the gate lines and a data driving circuit disposed on the base substrate and electrically connected with the data lines. During a display period of a frame, the gate driving circuit is configured to load gate scanning signals to respective gate lines sequentially; and while each gate line is loaded with a respective gate scanning signal, the data driving circuit is configured to transmit data signals to the data lines.

Embodiments of the disclosure provide an electronic paper, including the above-described array substrate.

Embodiments of the disclosure provide a driving method for the above-described array substrate, including: during a display period of a frame, loading gate scanning signals to gate lines sequentially by the gate driving circuit; and while each gate line is loaded with a respective gate scanning signal, transmitting data signals to data lines sequentially by the data driving sub-circuits.

Embodiments of the disclosure provide another driving method for the above-described array substrate, including: during a display period of a frame, loading gate scanning signals to gate lines sequentially by the gate driving circuit; and while each gate line is loaded with a respective gate scanning signal, transmitting, by respective groups of data driving sub-circuits, data signals to data lines corresponding to the respective groups of data driving sub-circuits simultaneously, and within each group of data driving sub-circuits, transmitting, by data driving sub-circuits in the group, data signals to data lines corresponding to the data driving sub-circuits in the group sequentially.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure. Those skilled in the art may easily obtain other drawings based on these figures, without any inventive work.

DETAILED DESCRIPTION

In order to make objects, technical details and advantages of the embodiments of the invention apparent, the technical solutions of the embodiments will be described in a clearly and fully understandable way in connection with the drawings related to the embodiments of the invention. Apparently, the described embodiments are just a part but not all of the embodiments of the disclosure. Based on the described embodiments herein, those skilled in the art can obtain all of other embodiments, without any inventive work, which should be within the scope of the invention.

Specific implementations of an array substrate, a driving method thereof and an electronic paper provided in embodiments of the disclosure will be described in detail below in connection with the accompanying drawings.

Figure 1:
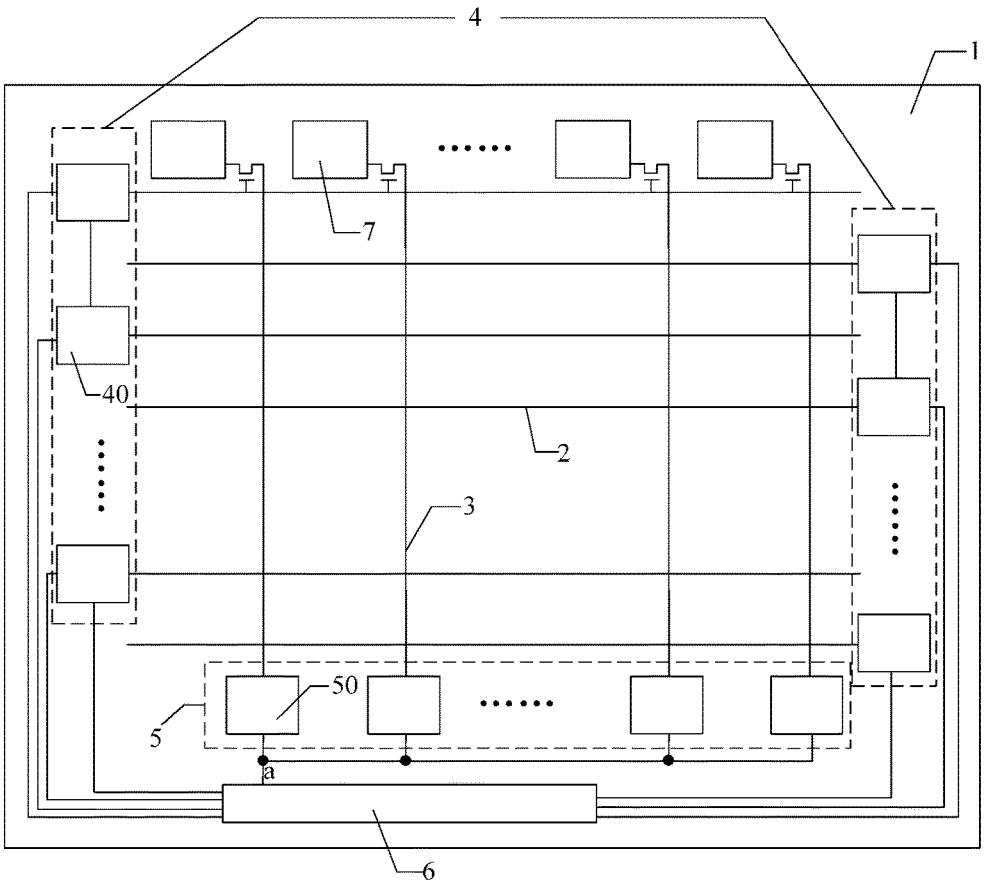
FIGS. 1-3 are structure diagrams of array substrates provided in embodiments of the disclosure, respectively.

An array substrate provided in embodiments of the disclosure, as shown in FIG. 1, includes: a base substrate 1, and a plurality of gate lines 2 and a plurality of data lines 3 disposed on the base substrate 1. The plurality of gate lines 2 and the plurality of data lines 3 are insulated from each other and extend across each other. The array substrate further includes: a gate driving circuit 4 disposed on the base substrate and electrically connected with the gate lines 2, and a data driving circuit 5 disposed on the base substrate and electrically connected with the data lines 3. During a display period of a frame, the gate driving circuit 4 is configured to load gate scanning signals to respective gate lines 2 sequentially (e.g., row by row); and while each gate line 2 is loaded with a respective gate scanning signal, the data driving circuit 5 is configured to transmit data signals to the data lines 3.

With the above-described array substrate provided in embodiments of the disclosure, both the gate driving circuit and the data driving circuit are integrated on the array substrate. During the display period of a frame, the gate driving circuit is configured to load gate scanning signals to respective gate lines in sequence; and while each gate line is loaded with a respective gate scanning signal, the data driving circuit is configured to transmit data signals to the data lines. As such, when the array substrate is applied in an electronic paper, all electrical signals including gate scanning signals and data signals may be provided by a printed circuit board, thereby leaving out the arrangement of integrated circuits. Thus, not only manufacturing costs of electronic papers can be reduced, but also a narrow rim design of electronic papers can be achieved.

For example, in the above-mentioned array substrate provided in the embodiments of the disclosure, as shown in FIG. 1, the gate driving circuit 4 may include a plurality of shift registers 40 that are in one-to-one correspondence with the gate lines 2. The shift registers 40 are electrically connected with pins 6 on the array substrate, respectively. The pins 6 are electrically connected with the printed circuit board bonded on the array substrate, and the printed circuit board controls the respective shift registers 40 to load gate scanning signals to respective gate lines 2 sequentially. By way of example, FIG. 1 illustrates that the shift registers 40 are divided into a left side and a right side to perform the driving function. In FIG. 1, each shift register 40 may have a circuit structure shown in FIG. 5. The operation process of the circuit structure may be similar to existing shift registers and will not be described here.

It is noted that the printed circuit board in embodiments of the disclosure may be replaced by a flexible circuit board. The flexible circuit board may be disposed on the array substrate as desired.

In some implementations, while gate scanning signals are applied to respective gate lines, the data driving circuit transmits data signals to data lines. For example, while a gate scanning signal is applied to each gate line, the data driving circuit may transmit data signals to each data line at the same time. However, in such a case, multiple sets of pins that are in one-to-one correspondence with the data lines are needed to be disposed on the array substrate, which makes the structure of the array substrate to be complicated and is not beneficial for a narrow rim design of the array substrate.

Based on this, in the above-mentioned array substrate provided in embodiments of the disclosure, as shown in FIG. 1, the data driving circuit 5 may include a plurality of data driving sub-circuits 50 that are in one-to-one correspondence with the data lines 3. Data driving sub-circuits 50 receive data signals via the same signal line a; and the data driving sub-circuits 50 are configured to transmit the received data signals to the respective data lines 3 sequentially. For example, through a one-column-by-one-column scanning, the data driving sub-circuits 50 sequentially transmit the received data signals to the data lines 3 corresponding to the respective data driving sub-circuits 50. In this way, only one set of pins 6 are needed to be disposed on the array substrate, and, via the signal line a connected with the pins 6, the printed circuit board controls the data driving sub-circuits 50 to load data signals to corresponding data lines 3 in sequence (e.g., one column by one column). While a respective gate scanning signal is applied to each gate line 2, the data driving sub-circuits 50 transmit data signals to corresponding data lines 3 sequentially by a one-column-by-one-column scanning; and thus, a refresh frequency may be low. However, it is applicable for an electronic paper with a low refresh frequency.

Figure 2:
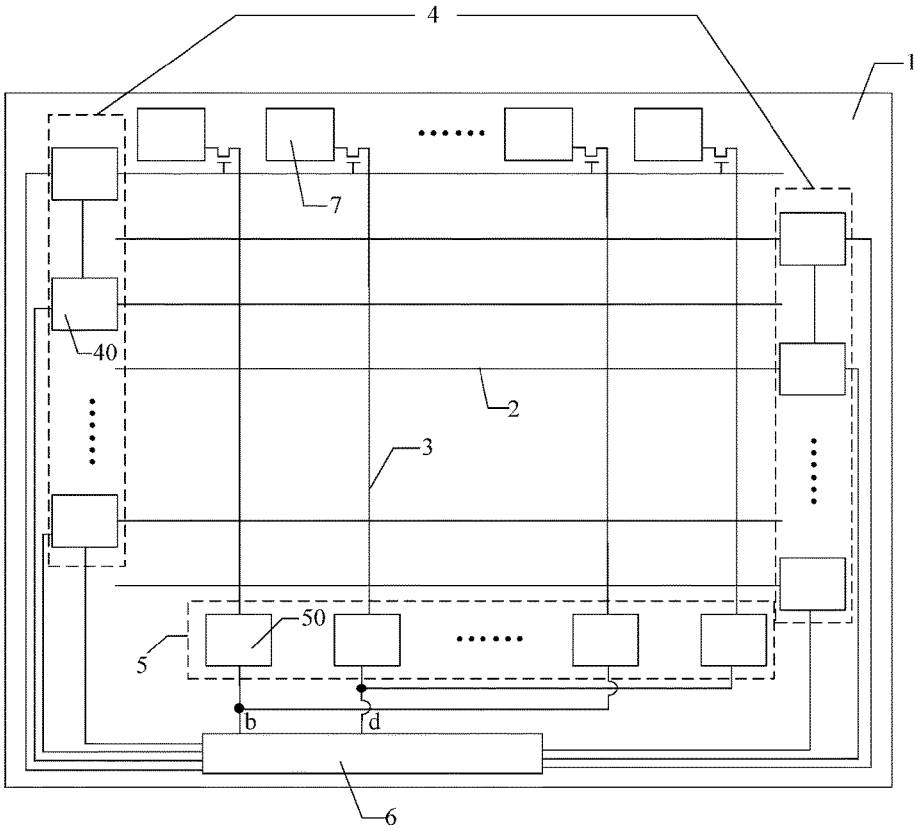

For example, in order to improve the refresh frequency in the above-mentioned array substrate provided in embodiments of the disclosure, as shown in FIG. 2, the data driving circuit 5 may include a plurality of data driving sub-circuits 50 that are in one-to-one correspondence with the data lines 3. The data driving sub-circuits 50 can be divided into at least two groups, and in each group the data driving sub-circuits 50 receive data signals via the same signal line. For example, as shown in FIG. 2, the data driving sub-circuits 50 are divided into two groups, where the data driving sub-circuits 50 in one group receive data signals via a signal line b, while the data driving sub-circuits 50 in another group receive data signals via another signal line d. Respective groups of data driving sub-circuits 50 are configured to transmit received data signals to data lines 3 corresponding to the respective groups of data driving sub-circuits 50 simultaneously; and within each group, the data driving sub-circuits 50 in that group are configured to transmit the received data signals to the data lines 3 corresponding to the data driving sub-circuits 50 in that group in sequence. For example, as shown in FIG. 2, first data driving sub-circuits 50 in a first group that are connected with the signal line b transmit the received data signals to the data lines 3 corresponding to the first data driving sub-circuits 50 sequentially by a one-column-by-one-column scanning; at the same time, second data driving sub-circuits 50 in a second group that are connected with the signal line d transmit the received data signals to the data lines 3 corresponding to the second data driving sub-circuits 50 sequentially by a one-column-by-one-column scanning. The first and second groups of data driving sub-circuits 50 operate independently. The array substrate shown in FIG. 2 may have a double refresh frequency compared to the array substrate shown in FIG. 1.

For example, in the above-mentioned array substrate provided in embodiments of the disclosure, as shown in FIG. 2, the data driving circuits 50 are divided into two groups. A first group may include data driving sub-circuits 50 corresponding to data lines 3 at odd-numbered columns, where the data lines 3 at the odd-numbered columns receive data signals via the signal line b. A second group may include data driving sub-circuits 50 corresponding to data lines 3 at even-numbered columns, where the data lines 3 at the even-numbered columns receive data signals via the signal line d. While the data driving sub-circuits 50 in the first group connected with the signal line b transmit received data signals to the data lines 3 at the odd-numbered columns sequentially, the data driving sub-circuits 50 in the second group connected with the signal line d transmit received data signals to the data lines 3 at the even-numbered columns sequentially. The two groups of data driving sub-circuits 50 operate independently. The array substrate shown in FIG. 2 may have a double refresh frequency as compared to the array substrate shown in FIG. 1.

Of course, in the above-mentioned array substrate provided in embodiments of the disclosure, the separation of the data driving sub-circuits into two groups is not limited to what is shown in FIG. 2. There may be other similar separation ways that can implement the disclosure, which is not limited herein. Furthermore, it is not limited to dividing the data driving sub-circuits into two groups, and the data driving sub-circuits may also be divided into three or four groups, etc., which is not limited herein. For example, the number of groups into which the data driving sub-circuits are divided may be configured according to an actual needed refresh frequency.

Figure 3:
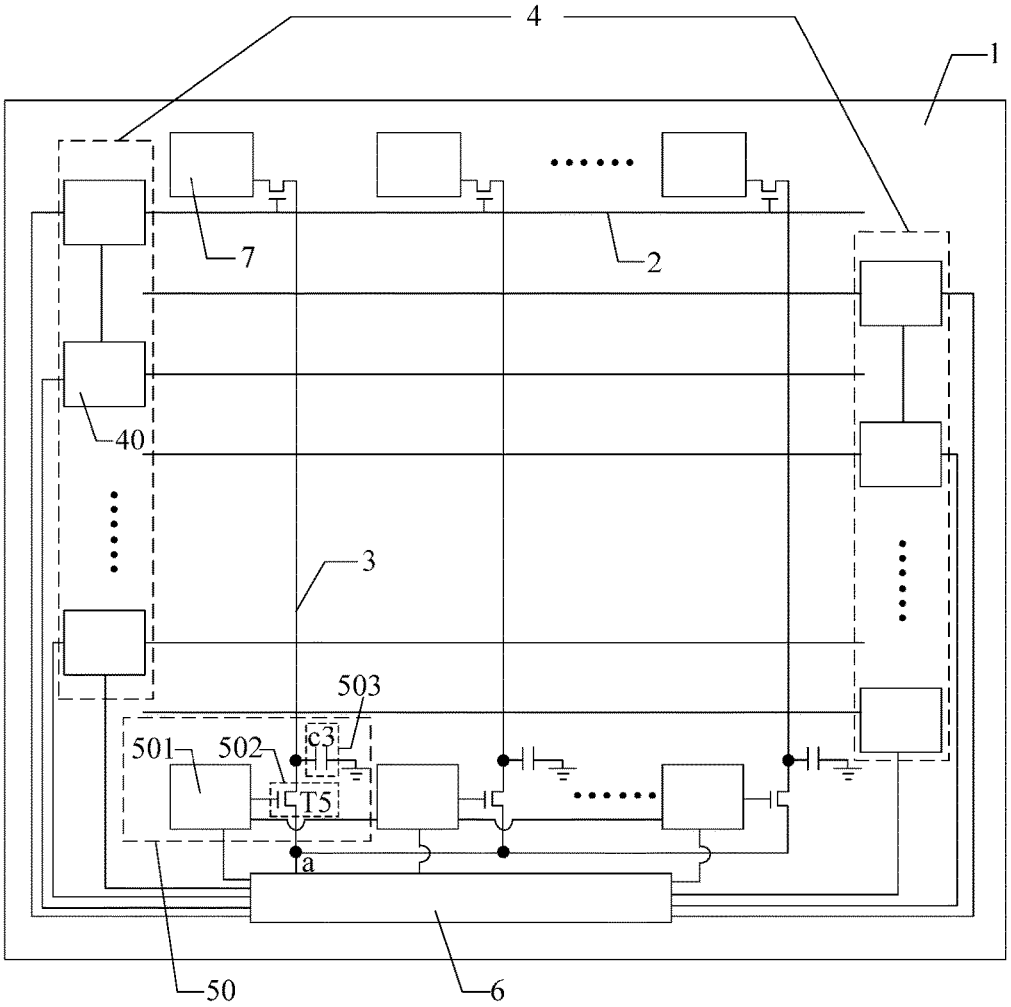

For example, in the above-mentioned array substrate provided in embodiments of the disclosure, as shown in FIG. 3, an example is described in which all data driving sub-circuits 50 receive data signals via the same signal line a. Each data driving sub-circuit 50 may include: a control unit 501, a switch unit 502 and a memory unit 503. In each data driving sub-circuit 50, the control unit 501 is configured to control the switch unit 502 in the data driving sub-circuit 50 to be turned on, such that the data driving sub-circuit 50 transmits a data signal to the data line 3 that corresponds to the data driving sub-circuit 50, and the memory unit 503 in the corresponding data driving sub-circuit 50 is configured to store the data signal when the switch unit 502 in the corresponding data driving sub-circuit 50 is turned on.

Figure 4:
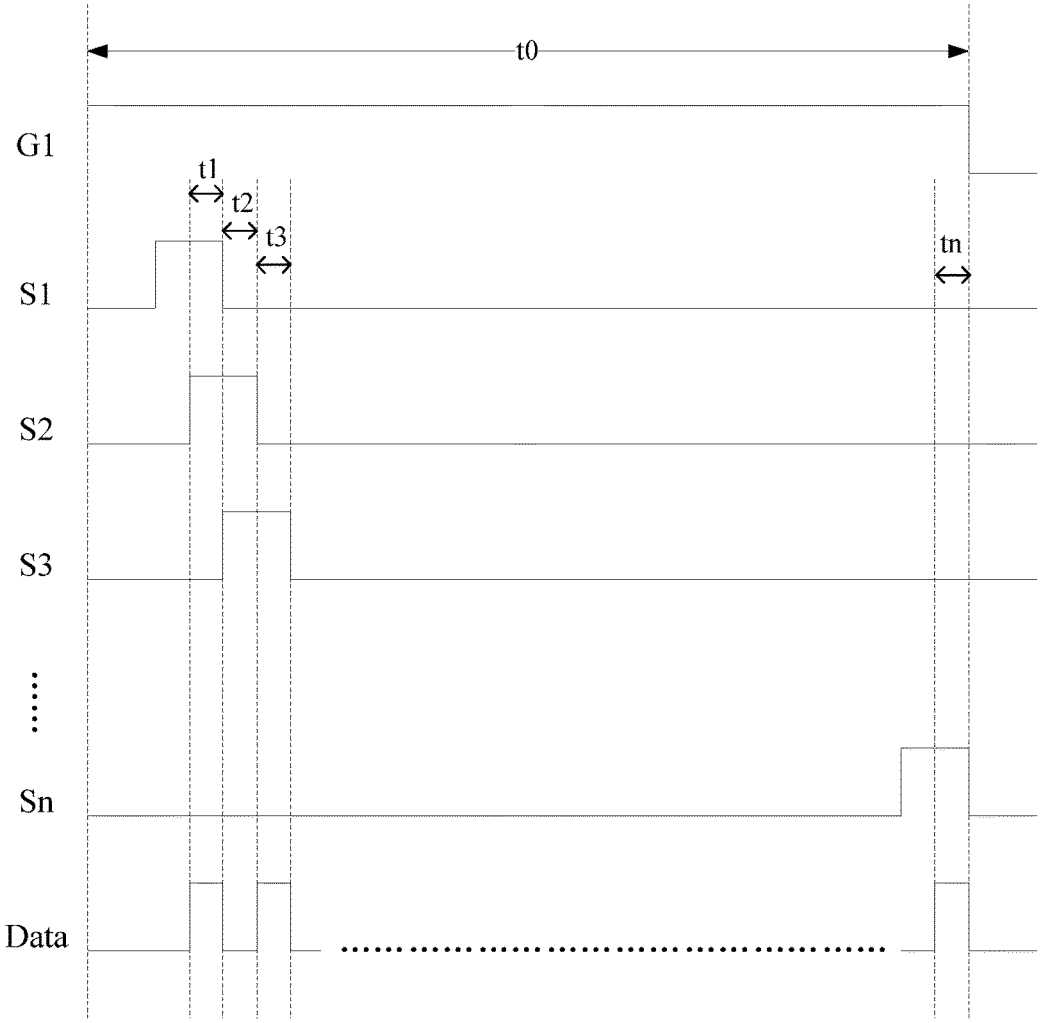
FIG. 4 is a driving timing diagram for an array substrate shown in FIG. 3.

For example, a driving timing diagram corresponding to the array substrate shown in FIG. 3 is illustrated in FIG. 4. During a period (t0) in which the gate driving circuit 4 loads a gate scanning signal G1 to the first gate line, the printed circuit board transmits timing signals S1, S2 . . . Sn to the control units 501 in respective data driving sub-circuits 50 sequentially and respectively, and the control units 501 control the switch units 502 to be turned on sequentially and respectively. For example, when the switch unit 502 corresponding to a first data line is in a turn-on state, the printed circuit board loads a data signal Data to the first data line, to achieve charging a pixel 7 that is electrically connected with the first gate line and the first data line with a charging time period t1 and to store the data signal Data in the memory unit 503 corresponding to the first data line. Similarly, when the switch unit 502 corresponding to a second data line is in a turn-on state, the printed circuit board loads another data signal Data to the second data line, to achieve charging another pixel 7 that is electrically connected with the first gate line and the second data line with a charging time period t2 and to store the other data signal Data in the memory unit 503 corresponding to the second data line; meanwhile, the data signal stored in the memory unit 503 corresponding to the first data line may keep the voltage of the pixel 7 (which is electrically connected with the first gate line and the first data line) unchanged. Similarly, when the switch unit 502 corresponding to the $n^{th}$ data line is in a turn-on state, the printed circuit board loads a data signal Data to the $n^{th}$ data line, to achieve charging a pixel 7 that is electrically connected with the first gate line and the $n^{th}$ data line with a charging time period to and to store the data signal in the memory unit 503 corresponding to the $n^{th}$ data line; meanwhile, the data signals stored in the memory units 503 which are respectively corresponding to data lines from the first data line to the $(n-1)^{th}$ data signal may keep the voltages of the respective pixels 7 unchanged. After completing scanning of all data lines 3, the application of the gate scanning signal G1 to the first gate line completes, and the application of a second gate scanning signal to the second gate line may start. Similarly, during the period in which the second gate scanning signal is applied to the second gate line, all data lines 3 are scanned column by column again. The display of an image frame is accomplished when scanning of all gate lines 2 completes in a similar way.

Figure 6A:
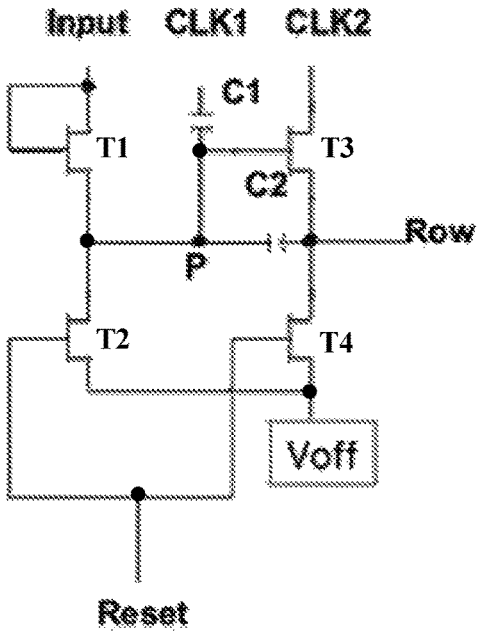
FIG. 6A is a diagram showing a control unit in each data driving sub-circuit of an array substrate provided in an embodiment of the disclosure.

For example, in the above-mentioned array substrate provided in the embodiments of the disclosure, as shown in FIG. 6A, the control unit 501 in each data driving sub-circuit may include: a first switching transistor T1, a second switching transistor T2, a third switching transistor T3, a fourth switching transistor T4, a first capacitor c1 and a second capacitor c2.

For example, a gate and a source of the first switching transistor T1 are electrically connected with the signal input terminal Input, and a drain of the first switching transistor T1 is electrically connected with a first node P.

For example, a gate of the second switching transistor T2 is electrically connected with a reset signal terminal Reset, a source of the second switching transistor T2 is configured to receive a signal Voff with a low voltage level, and a drain of the second switching transistor T2 is electrically connected with the first node P.

For example, a gate of the third switching transistor T3 is electrically connected with the first node P, a source of the third switching transistor T3 is configured to receive a second timing signal CLK2, and a drain of the third switching transistor T3 is electrically connected with a signal output terminal Row.

For example, a gate of the fourth switching transistor T4 is electrically connected with the reset signal terminal Reset, a source of the fourth switching transistor T4 is configured to receive the signal Voff with the low voltage level, and a drain of the fourth switching transistor T4 is electrically connected with the signal output terminal Row.

For example, a first terminal of the first capacitor c1 is configured to receive the first timing signal CLK1, a second terminal of the first capacitor c1 is electrically connected with the first node P.

For example, a first terminal of the second capacitor c2 is electrically connected with the first node P, and a second terminal of the second capacitor c2 is electrically connected with the signal output terminal Row.

Figure 6B:
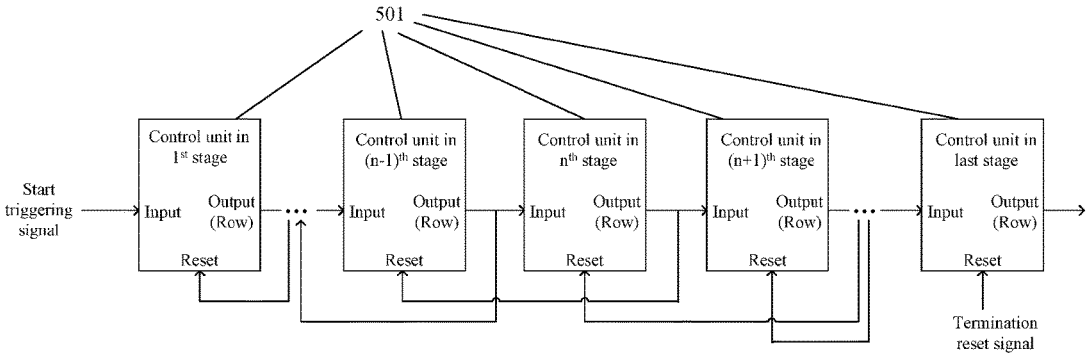
FIG. 6B is a diagram of cascade control units in data driving sub-circuits of an array substrate provided in an embodiment of the disclosure.

In some implementations, control units of the above-mentioned array substrate provided in embodiments of the disclosure may be connected in a concatenation approach. As shown in FIG. 6B, an example connection includes: other than the control unit in the first stage, a signal output terminal of each control unit in any other stage is connected with a reset signal terminal of a previous adjacent control unit; other than the control unit in the last stage, a signal output terminal of each control unit in any other stage is connected with a signal input terminal of a next adjacent control unit; a signal input terminal of the control unit in the first stage is configured to receive a start triggering signal; and a reset signal terminal of the control unit in the last stage is configured to receive a termination reset signal. The control units in respective stages shown in FIG. 6B may each have a structure similar to that of the control unit shown in FIG. 6A. Similarly, as shown in FIG. 3, the signal output terminal Row of the control unit in a respective stage is also electrically connected with the switching transistor T5 in the same data driving sub-circuit. For example, referring to the control unit in the $n^{th}$ stage as an example, the signal output terminal Row(n) of the control unit in the $n^{th}$ stage is connected with the reset signal terminal Reset(n−1) of the control unit in the $(n-1)^{th}$ stage and the signal input terminal Input(n+1) of the control unit in the $(n+1)^{th}$ stage, respectively; and at the same time, the signal output terminal Row(n) of the control unit in the $n^{th}$ stage is also electrically connected with a gate of a switching transistor T5 in a same data driving sub-circuit.

Of course, in the above-mentioned array substrate provided in embodiments of the disclosure, connections of the control units are not limited to the concatenation approach, and the control units may also be connected in a way that can implement the disclosure, which is not limited herein.

Figure 7:
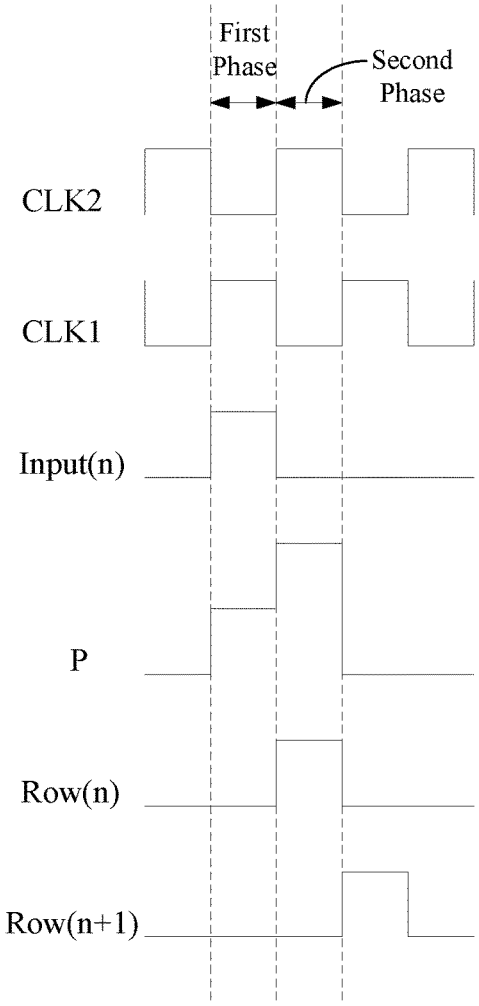
FIG. 7 is a driving timing diagram corresponding to a control unit shown in FIG. 6A.

An operation principle will be described in detail below when the control unit in each data driving sub-circuit provided in embodiments of the disclosure employs the circuit structure shown in FIG. 6A and all the control units corresponding to the data driving sub-circuits are cascaded. FIG. 7 is a driving timing diagram corresponding to the control unit shown in FIG. 6A. The control unit in the $n^{th}$ stage will be described as an example. In a first phase, a first timing signal CLK1 has a high level voltage, a second timing signal CLK2 has a low level voltage, the signal input terminal Input(n) is inputted with a high level voltage signal to control the first switching transistor T1 to be turned on, thereby connecting the signal input terminal Input(n) with the first node P and causing the first node P to have a high level voltage. In a second phase, the first timing signal CLK1 has a low level voltage, the second timing signal CLK2 has a high level voltage, the first node P is at the high voltage level to control the third switching transistor T3 to be turned on, thereby connecting the second timing signal CLK2 with the signal output terminal Row(n) and causing the signal output terminal Row(n) to output a high level voltage; at the same time, due to the bootstrap effect of the second capacitor c2, the potential of the first node P is raised to a higher voltage level; at the same time, the signal output terminal Row(n) is at the high voltage level, causing the reset signal terminal Reset(n−1) of the control unit in the $(n-1)^{th}$ stage to be at the high voltage level to control the second switching transistor T2 and the fourth switching transistor T4 of the control unit in the $(n-1)^{th}$ stage to be turned on, thereby causing the first node P and the signal output terminal Row(n−1) of the control unit in the $(n-1)^{th}$ stage to receive a signal Voff with a low level voltage and to pull down the potential of the first node P and the signal output terminal Row(n−1) of the control unit in the $(n-1)^{th}$ stage; and at the same time, the signal output terminal Row(n) of the control unit in the $n^{th}$ stage and the signal input terminal Input(n+1) of the control unit in the $(n+1)^{th}$ stage are electrically connected to control the control unit in the $(n+1)^{th}$ stage to start similar operations.

For example, in the above-mentioned array substrate provided in embodiments of the disclosure, as shown in FIG. 3, the switch unit may include the fifth switching transistor T5. In each data driving sub-circuit 50: a gate of the fifth switching transistor T5 is electrically connected with the signal output terminal Row of the control unit 501 in the corresponding data driving sub-circuit 50; a source of the fifth switching transistor T5 is electrically connected with the data signal terminal in the pins 6; and a drain of the fifth switching transistor T5 is electrically connected with the data line 3 corresponding to the data driving sub-circuit 50.

For example, the fifth switching transistor T5 may be an N-type transistor or a P-type transistor, which is not limited herein. FIG. 3 will be described with reference to the fifth switching transistor T5 being an N-type transistor as an example.

An operation principle will be described in detail below when the switch unit in each data driving sub-circuit provided in embodiments of the disclosure employs the fifth switching transistor T5 as an example structure. The signal output terminal Row of the control unit 501 in each data driving sub-circuit 50 inputs a signal with a high voltage level to the fifth switching transistor T5 in the data driving sub-circuit 50 to control the fifth switching transistor T5 to be turned on, and thus, the data signal terminal in the pins 6 is electrically connected with the data line 3 corresponding to the data driving sub-circuit 50, and a data signal is loaded to the data line 3.

For example, in the above-mentioned array substrate provided in embodiments of the disclosure, as shown in FIG. 3, the memory unit may include a third capacitor c3. A first terminal of the third capacitor c3 in each data driving sub-circuit 50 is electrically connected with the drain of the fifth switching transistor T5, and a second terminal of the third capacitor c3 in each data driving sub-circuit 50 is grounded.

An operation principle will be described in detail below when the memory unit in each data driving sub-circuit provided in embodiments of the disclosure employs the third capacitor c3 as an example structure. The signal output terminal Row of the control unit 501 in each data driving sub-circuit 50 inputs a signal with a high voltage level to the fifth switching transistor T5 in the data driving sub-circuit 50 to control the fifth switching transistor T5 to be turned on, causing the data signal terminal in the pins 6 to be electrically connected with the third capacitor c3 in the data driving sub-circuit 50 to charge the third capacitor c3.

Figure 5:
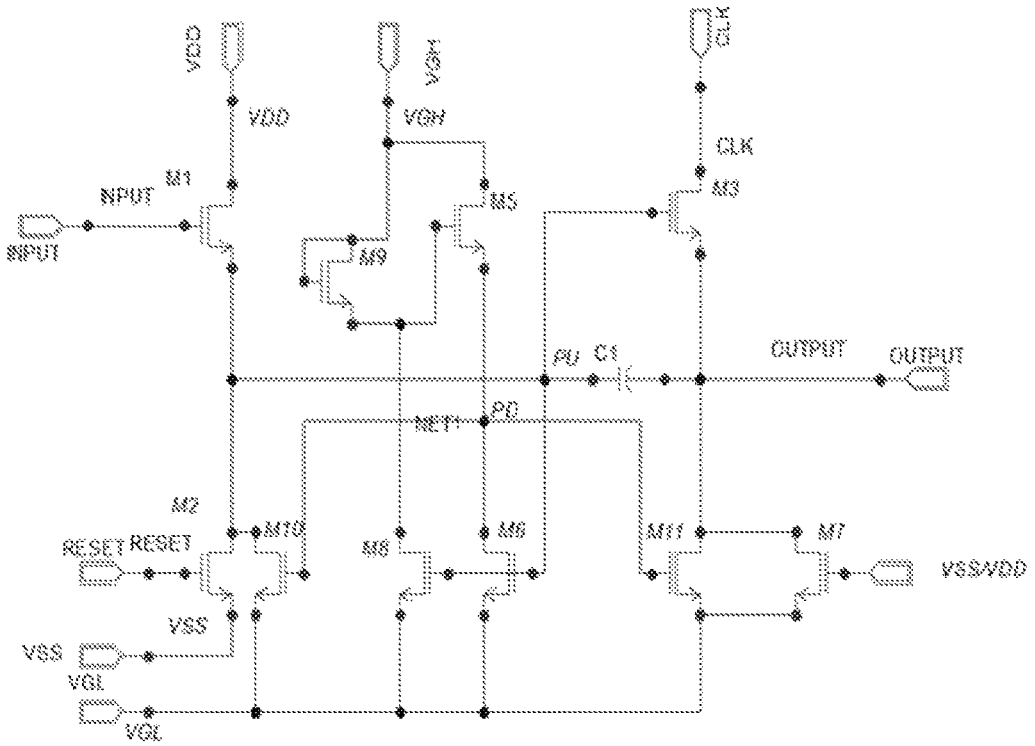
FIG. 5 is a diagram showing a shift register in a gate driving circuit of an array substrate provided in an embodiment of the disclosure.

For example, the printed circuit board needs to provide eight signals including CLK, CLKB, CLK1, CLK2, STV, VDD, VSS and VGL to the shift register 40 shown in FIG. 5 and the control unit 501 shown in FIG. 6A respectively. Voff in FIG. 6A may be VSS or VGL. Further, the shift register 40 shown in FIGS. 1-3 performs a driving function on both a left side and a right side. Further, the printed circuit board needs to further provide signals such as Data, Vcom and GND, etc. Therefore, the printed circuit board needs at least 21 basic signal outputs. Besides, in order to enhance the antistatic capability of the printed circuit board, it is needed to add a Vcom signal and a GND signal on the left side and the right side of the printed circuit board, respectively. Therefore, the printed circuit board needs 23 signal outputs altogether. The above-described scenario refers to four phases as an example. If eight phases are employed, corresponding signal sources can be added accordingly.

Based on the same inventive concept, an embodiment of the disclosure further provides an electronic paper including the above-mentioned array substrate. The embodiments of the above-mentioned array substrate may be referred to for specific implementations of the electronic paper, and similar descriptions will not be repeated herein.

Based on the array substrate shown in FIG. 1 as provided in embodiments of the disclosure, an embodiment of the disclosure further provides a method for driving the array substrate, including:

during a display period of a frame, loading, by the gate driving circuit, gate scanning signals to gate lines sequentially; and while each gate line is loaded with a respective gate scanning signal, transmitting data signals to data lines sequentially by the data driving sub-circuits. The embodiments of the above-mentioned array substrate may be referred to for specific implementations of the driving method and similar descriptions will not be repeated herein.

Based on the array substrate shown in FIG. 2 as provided in embodiments of the disclosure, an embodiment of the disclosure further provides a method for driving the array substrate, including:

during a display period of a frame, loading, by the gate driving circuit, gate scanning signals to gate lines sequentially; and while each gate line is loaded with a respective gate scanning signal, transmitting, by respective groups of data driving sub-circuits, data signals to data lines corresponding to the respective groups of data driving sub-circuits simultaneously, and within each group of data driving sub-circuits, transmitting, by data driving sub-circuits in that group, data signals to data lines corresponding to the data driving sub-circuits in that group sequentially. The embodiments of the above-mentioned array substrate may be referred to for specific implementations of the driving method and similar descriptions will not be repeated herein.

For example, in the above-mentioned method provided in the embodiment of the disclosure, the step "while each gate line is loaded with a respective gate scanning signal, transmitting, by respective groups of data driving sub-circuits, data signals to data lines corresponding to the respective groups of data driving sub-circuits simultaneously, and within each group of data driving sub-circuits, transmitting, by data driving sub-circuits in that group, data signals to data lines corresponding to the data driving sub-circuit in that group sequentially" may be implemented in the following example manner:

transmitting data signals to data lines at odd-numbered columns sequentially by a first group of data driving sub-circuits corresponding to the data lines at the odd-numbered columns; and at the same time, transmitting data signals to data lines at even-numbered columns sequentially by a second group of data driving sub-circuits corresponding to the data lines at the even-numbered columns. These two groups of data driving sub-circuits operate independently, which may increase the refresh frequency of the electronic paper.

With the above-described array substrate, the driving method thereof and the electronic paper provided in the embodiments of the disclosure, both the gate driving circuit and the data driving circuit are integrated on the array substrate. During the display period of a frame, the gate driving circuit is configured to load gate scanning signals to respective gate lines in sequence; and while each gate line is loaded with a respective gate scanning signal, the data driving circuit is configured to transmit data signals to data lines. As such, when the array substrate is applied in an electronic paper, all electrical signals including gate scanning signals and data signals may be provided by a printed circuit board, thereby omitting the arrangement of integrated circuits. Thus, not only manufacturing costs of electronic papers can be reduced, but also a narrow rim design of electronic papers can be achieved.

Apparently, those skilled in the art can make modifications and variations to the disclosure without departing from the spirit and scope of the disclosure. Thus, if these modifications and variations of the disclosure fall within the scope of claims and their equivalents of the disclosure, it is intended that the disclosure also encompass these modifications and variations.

It is noted that in the drawings, dimensions of layers and regions may be exaggerated for clear illustration. It is understood that when an element or a layer is said to be "on" another element or layer, it may be on the other element or layer directly, or there may be an intervening layer. Further, it is understood that when an element or a layer is said to be "under" another element or layer, it may be under the other element or layer directly, or there may be more than one intervening layers or elements. Further, it is also understood that when a layer or an element is said to be "between" two layers or two elements, it may be the only layer or element between the two layers or two elements, or there may be more than one intervening layers or elements. Similar reference numerals refer to similar elements throughout the description.

Further, in the description, relational terms such as first, second, etc. are used only to differentiate one entity or operation from another entity or operation rather than necessarily requiring or implying any such actual relationship or order among these entities or operations. Further, terms "include", "comprise" or any other variants thereof are intended to encompass non-exclusive inclusion such that a process, method, article or device including a series of elements includes not only those elements, but also other elements that have not been listed explicitly, or further includes elements inherent in the process, method, article or device. Without any further limitations, an element defined by expression "including a . . . " does not exclude additional identical elements in the process, method, article or device including said element.

It is to be further noted that terms "on", "under", etc. refer to the azimuth or position relationship based on what is shown in figures, which are only for the purpose of facilitating describing the disclosure and simplifying description rather than indicating or implying that the mentioned devices or elements must have certain azimuth, must be constructed and operated in certain azimuth, and therefore are not constructed as limiting the disclosure. Unless otherwise stated and defined specifically, terms "mount", "connected with" and "connect" should be understood in a broad sense; for example, the connection may be a fixed connection, or detachable connection, or integral connection; may be a mechanical connection, or an electrical connection; may be a direct connection, or connection through a intermediate medium, or a communication inside two elements. For those of ordinary skill in the art, specific meanings of the above-mentioned terms in the disclosure may be understood depending on specific conditions.

What are described above is related to the illustrative embodiments of the disclosure only and not limitative to the scope of the disclosure. Those skilled in the art may easily think of any alteration or replacement within the technical field described herein, which are also within the scope of the disclosure. The scopes of the disclosure are defined by the accompanying claims.

This application claims a priority of Chinese patent application No. 201510166590.X filed on Apr. 9, 2015, the disclosure of which is incorporated herein by reference in its entirety.

The invention claimed is:

1. An array substrate, comprising:

a base substrate;

a plurality of gate lines and a plurality of data lines disposed on the base substrate, the plurality of gate lines and the plurality of data lines being insulated from each other and extending across each other;

a gate driving circuit integrated on the base substrate and electrically connected with the gate lines and a data driving circuit integrated on the base substrate and electrically connected with the data lines; wherein:

during a display period of a frame, the gate driving circuit is configured to load gate scanning signals to the gate lines sequentially and respectively; and while each gate line is loaded with a respective gate scanning signal, the data driving circuit is configured to transmit data signals to the data lines;

the data driving circuit comprises a plurality of data driving sub-circuits that are in one-to-one correspondence with the data lines, each data driving sub-circuit comprises a control unit, a switch unit and a memory unit; and in each data driving sub-circuit:

the control unit is configured to control the switch unit in the data driving sub-circuit to be turned on such that the data driving sub-circuit transmits a data signal to a data line corresponding to the data driving sub-circuit; and the memory unit in the data driving sub-circuit is configured to store the data signal when the switch unit in the data driving sub-circuit is turned on.

2. The array substrate of claim 1, wherein the data driving sub-circuits receive data signals via a same signal line, and the data driving sub-circuits are configured to transmit the received data signals to the data lines sequentially.

3. The array substrate of claim 1, wherein the data driving sub-circuits are divided into at least two groups, and the data driving sub-circuits in each same group receive data signals via a same signal line, and wherein the two groups of data driving sub-circuits are configured to transmit received data signals to data lines corresponding to the respective groups of data driving sub-circuits simultaneously, and within each group, corresponding data driving sub-circuits in that group are configured to transmit the received data signals to the data lines corresponding to the data driving sub-circuits in that group sequentially.

4. The array substrate of claim 3, wherein the data driving sub-circuits are divided into two groups, one group comprises data driving sub-circuits corresponding to data lines at odd-numbered columns, and another group comprises data driving sub-circuits corresponding to data lines at even-numbered columns.

5. The array substrate of claim 1, wherein the control unit comprises: a first switching transistor, a second switching transistor, a third switching transistor, a fourth switching transistor, a first capacitor and a second capacitor;

a gate and a source of the first switching transistor are electrically connected with a signal input terminal, and a drain of the first switching transistor is electrically connected with a first node;

a gate of the second switching transistor is electrically connected with a reset signal terminal, a source of the second switching transistor is configured to receive a signal with a low voltage level, and a drain of the second switching transistor is electrically connected with the first node;

a gate of the third switching transistor is electrically connected with the first node, a source of the third switching transistor is configured to receive a second timing signal, and a drain of the third switching transistor is electrically connected with a signal output terminal;

a gate of the fourth switching transistor is electrically connected with the reset signal terminal, a source of the fourth switching transistor is configured to receive the signal with a low voltage level, and a drain of the fourth switching transistor is electrically connected with the signal output terminal;

a first terminal of the first capacitor is configured to receive a first timing signal, a second terminal of the first capacitor is electrically connected with the first node; and a first terminal of the second capacitor is electrically connected with the first node, and a second terminal of the second capacitor is electrically connected with the output signal terminal.

6. The array substrate of claim 5, wherein control units corresponding to the data driving sub-circuits are connected in a concatenation approach;

other than a control unit in a first stage, a signal output terminal of each control unit in any other stage is connected with a reset signal terminal of a previous adjacent control unit;

other than a control unit in a last stage, a signal output terminal of each control unit in any other stage is connected with a signal input terminal of a next adjacent control unit;

a signal input terminal of the control unit in the first stage is configured to receive a start triggering signal; and a reset signal terminal of the control unit in the last stage is configured to receive a termination reset signal.

7. The array substrate of claim 1, wherein the switch unit comprises a fifth switching transistor, and in each data driving sub-circuit:

a gate of the fifth switching transistor in the data driving sub-circuit is electrically connected with a signal output terminal of the control unit in the data driving sub-circuit, a source of the fifth switching transistor is electrically connected with a data signal terminal, and a drain of the fifth switching transistor is electrically connected with a data line corresponding to the data driving sub-circuit.

8. The array substrate of claim 7, wherein the memory unit comprises a third capacitor; and in each data driving sub-circuit:

a first terminal of the third capacitor in the data driving sub-circuit is electrically connected with the drain of the fifth switching transistor in the data driving sub-circuit, and a second terminal of the third capacitor is grounded.

9. An electronic paper, comprising the array substrate of claim 1.

10. A driving method for the array substrate of claim 2, comprising:

during a display period of a frame, loading the gate scanning signals to the gate lines sequentially by the gate driving circuit; and while each gate line is loaded with a respective gate scanning signal, transmitting the data signals to the data lines sequentially by the data driving sub-circuits.

11. A driving method for the array substrate of claim 3, comprising:

during a display period of a frame, loading the gate scanning signals to the gate lines sequentially by the gate driving circuit; and while each gate line is loaded with a respective gate scanning signal, transmitting, by respective groups of data driving sub-circuits, data signals to data lines corresponding to the respective groups of data driving sub-circuits simultaneously, and within each group of data driving sub-circuits, transmitting, by data driving sub-circuits in the group, data signals to data lines corresponding to the data driving sub-circuits in the group sequentially.

12. The method of claim 11, wherein while each gate line is loaded with a respective gate scanning signal, transmitting, by respective groups of data driving sub-circuits, data signals to data lines corresponding to the respective groups of data driving sub-circuits simultaneously, and within each group of data driving sub-circuits, transmitting, by data driving sub-circuits in the group, data signals to data lines corresponding to the data driving sub-circuits in the group sequentially comprises:

transmitting, by a first group of data driving sub-circuits corresponding to data lines at odd-numbered columns, data signals to the data lines at the odd-numbered columns sequentially; and at the same time, transmitting, by a second group of data driving sub-circuits corresponding to data lines at even-numbered columns, data signals to the data lines at the even-numbered columns sequentially.

13. The array substrate of claim 1, wherein the gate driving circuit comprises a plurality of shift registers that are in one-to-one correspondence with the gate lines, and wherein the shift registers are electrically connected with pins on the array substrate, and the pins are electrically connected with a printed circuit board bonded on the array substrate.

14. The array substrate of claim 13, wherein the printed circuit board controls the shift registers to load the gate scanning signals to the gate lines sequentially.

15. The array substrate of claim 13, wherein the data driving sub-circuits receive the data signals via a same signal line, the same signal line being connected with the pins, and the printed circuit board controls, through the same signal line, the data driving sub-circuits to load the data signals to the data lines sequentially and respectively.

16. The array substrate of claim 13, wherein the data driving sub-circuits are divided into two groups; and for each group of data driving sub-circuits:

data driving sub-circuits in the group receive data signals via a same signal line, the same signal line being connected with the pins; and the printed circuit board controls, through the same signal line, the data driving sub-circuits in the group to load the data signals to data lines that corresponds to the data driving sub-circuits in the group sequentially and respectively.

17. An array substrate, comprising:

a base substrate;

a plurality of gate lines and a plurality of data lines disposed on the base substrate, the plurality of gate lines and the plurality of data lines being insulated from each other and extending across each other;

a gate driving circuit disposed on the base substrate and electrically connected with the gate lines; and a data driving circuit disposed on the base substrate and electrically connected with the data lines; wherein:

during a display period of a frame, the gate driving circuit is configured to load gate scanning signals to the gate lines sequentially and respectively; and while each gate line is loaded with a respective gate scanning signal, the data driving circuit is configured to transmit data signals to the data lines;

the data driving circuit comprises a plurality of data driving sub-circuits that are in one-to-one correspondence with the data lines;

the data driving sub-circuits receive data signals via a same signal line; and the data driving sub-circuits are configured to transmit the received data signals to the data lines sequentially;

each data driving sub-circuit comprises a control unit, a switch unit and a memory unit;

in each data driving sub-circuit:

the control unit is configured to control the switch unit in the data driving sub-circuit to be turned on such that the data driving sub-circuit transmits a data signal to a data line corresponding to the data driving sub-circuit; and the memory unit in the data driving sub-circuit is configured to store the data signal when the switch unit in the data driving sub-circuit is turned on;

the control unit comprises: a first switching transistor, a second switching transistor, a third switching transistor, a fourth switching transistor, a first capacitor and a second capacitor;

a gate and a source of the first switching transistor are electrically connected with a signal input terminal, and a drain of the first switching transistor is electrically connected with a first node;

a gate of the second switching transistor is electrically connected with a reset signal terminal, a source of the second switching transistor is configured to receive a signal with a low voltage level, and a drain of the second switching transistor is electrically connected with the first node;

a gate of the third switching transistor is electrically connected with the first node, a source of the third switching transistor is configured to receive a second timing signal, and a drain of the third switching transistor is electrically connected with a signal output terminal;

a gate of the fourth switching transistor is electrically connected with the reset signal terminal, a source of the fourth switching transistor is configured to receive the signal with a low voltage level, and a drain of the fourth switching transistor is electrically connected with the signal output terminal;

a first terminal of the first capacitor is configured to receive a first timing signal, a second terminal of the first capacitor is electrically connected with the first node; and a first terminal of the second capacitor is electrically connected with the first node, and a second terminal of the second capacitor is electrically connected with the output signal terminal.

18. An array substrate, comprising:

a base substrate;

a plurality of gate lines and a plurality of data lines disposed on the base substrate, the plurality of gate lines and the plurality of data lines being insulated from each other and extending across each other;

a gate driving circuit disposed on the base substrate and electrically connected with the gate lines; and a data driving circuit disposed on the base substrate and electrically connected with the data lines; wherein:

during a display period of a frame, the gate driving circuit is configured to load gate scanning signals to the gate lines sequentially and respectively; and while each gate line is loaded with a respective gate scanning signal, the data driving circuit is configured to transmit data signals to the data lines;

the data driving circuit comprises a plurality of data driving sub-circuits that are in one-to-one correspondence with the data lines;

the data driving sub-circuits are divided into at least two groups; the data driving sub-circuits in each same group receive data signals via a same signal line;

the two groups of data driving sub-circuits are configured to transmit received data signals to data lines corresponding to the respective groups of data driving sub-circuits simultaneously, and within each group, corresponding data driving sub-circuits in that group are configured to transmit the received data signals to the data lines corresponding to the data driving sub-circuits in that group sequentially;

each data driving sub-circuit comprises a control unit, a switch unit and a memory unit;

in each data driving sub-circuit:

the control unit is configured to control the switch unit in the data driving sub-circuit to be turned on such that the data driving sub-circuit transmits a data signal to a data line corresponding to the data driving sub-circuit; and the memory unit in the data driving sub-circuit is configured to store the data signal when the switch unit in the data driving sub-circuit is turned on;

the control unit comprises: a first switching transistor, a second switching transistor, a third switching transistor, a fourth switching transistor, a first capacitor and a second capacitor;

a gate and a source of the first switching transistor are electrically connected with a signal input terminal, and a drain of the first switching transistor is electrically connected with a first node;

a gate of the second switching transistor is electrically connected with a reset signal terminal, a source of the second switching transistor is configured to receive a signal with a low voltage level, and a drain of the second switching transistor is electrically connected with the first node;

a gate of the third switching transistor is electrically connected with the first node, a source of the third switching transistor is configured to receive a second timing signal, and a drain of the third switching transistor is electrically connected with a signal output terminal;

a gate of the fourth switching transistor is electrically connected with the reset signal terminal, a source of the fourth switching transistor is configured to receive the signal with a low voltage level, and a drain of the fourth switching transistor is electrically connected with the signal output terminal;

a first terminal of the first capacitor is configured to receive a first timing signal, a second terminal of the first capacitor is electrically connected with the first node; and a first terminal of the second capacitor is electrically connected with the first node, and a second terminal of the second capacitor is electrically connected with the output signal terminal.

* * * * *